US008839969B2

(12) United States Patent
Willim

(10) Patent No.: US 8,839,969 B2
(45) Date of Patent: Sep. 23, 2014

(54) LATTICE PIECE AND CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 77 days.

(21) Appl. No.: 13/197,891

(22) Filed: Aug. 4, 2011

(65) Prior Publication Data

US 2012/0031868 A1 Feb. 9, 2012

(30) Foreign Application Priority Data

Aug. 6, 2010 (DE) ..... 20 2010 011 131 U

(51) Int. Cl.
*B66C 23/68* (2006.01)
*B66C 23/70* (2006.01)

(52) U.S. Cl.
CPC ..... *B66C 23/70* (2013.01)
USPC ..... 212/299; 212/347

(58) Field of Classification Search
USPC ..... 212/175–177, 294, 295, 297, 299, 212/347–349, 271
See application file for complete search history.

(56) References Cited

U.S. PATENT DOCUMENTS

| | | | | | |
|---|---|---|---|---|---|
| 3,564,789 | A | * | 2/1971 | Vyvyan et al. | 52/108 |
| 3,578,787 | A | * | 5/1971 | Brickett et al. | 212/289 |
| 5,016,418 | A | * | 5/1991 | Rhodes et al. | 52/646 |
| 5,125,206 | A | | 6/1992 | Motohashi et al. | |
| 5,163,262 | A | * | 11/1992 | Adams | 52/646 |
| 2008/0173605 | A1 | | 7/2008 | Willim | |

FOREIGN PATENT DOCUMENTS

| | | | |
|---|---|---|---|
| DE | 10 2006 060 347 | A1 | 6/2008 |
| EP | 1935833 | A1 | 6/2008 |
| WO | WO2006034847 | A1 | 4/2006 |
| WO | WO2009095243 | A2 | 8/2009 |
| WO | WO2010003681 | A1 | 1/2010 |
| WO | WO2010046049 | A1 | 4/2010 |

OTHER PUBLICATIONS

Search Report from French Patent Office in a counterpart French application, Dated: Jan. 25, 2013.

* cited by examiner

*Primary Examiner* — Emmanuel M Marcelo
*Assistant Examiner* — Angela Caligiuri
(74) *Attorney, Agent, or Firm* — The PL Law Group, PLLC

(57) ABSTRACT

A lattice piece for a crane includes four corner posts and of null bars and diagonal bars connecting the same, wherein at least a part of the null and diagonal bars are foldably articulated to at least one corner post, and at least one adjusting unit is provided for performing the folding movement, wherein at least one drive is connected or connectable with at least one adjusting unit.

7 Claims, 2 Drawing Sheets

LATTICE PIECE AND CRANE

CROSS-REFERENCE TO RELATED APPLICATION AND CLAIM OF PRIRITY

This application claims the benefit of German Utility Model Application No. 20 2010 011 131.5, filed on Aug. 6, 2010, in the German Patent and Trademark Office, the disclosures of which are incorporated herein in their entirety by reference.

BACKGROUND

1. Field of the Invention

This invention relates to a lattice piece for a crane and to a crane with such lattice piece.

2. Description of the Related Art

Cranes, in particular large mobile cranes, are transported to the respective sites of use on public roads. Here, the rules of public road traffic are applicable, for example in Germany the rules of the Road Traffic Regulations. In these regulations, the maximum admissible weights and also dimensions of the crane to be transported are defined. In other countries similar regulations apply correspondingly.

These regulations lead to the fact that the dimension of the parts to be transported is limited, whereby the total size of the mobile crane and therefore the maximum achievable lifting capacity is limited.

Different approaches are already known from the present state of the art, in order to comply with the limitations during transport of the crane without reducing the achievable lifting capacity to an unnecessary extent.

It is proposed, for example, to completely demount the body of the crane, in particular the lattice boom of a lattice crane, and separately move the separated individual parts. However, the dimension of an individual lattice piece already can exceed the admissible transport size.

In DE 10 2006 060 347 A1 it is proposed to design the individual lattice piece so as to be foldable, in order to comply with the admissible transport dimensions. Such crane boom first is dismantled into its individual lattice pieces, wherein the same subsequently are folded and transported in this dismantled form.

A disadvantage of the above suggestion, however, consists in that the folding operation of the lattice piece must be effected manually. The larger the physical dimension of the lattice piece, the more force must be applied for the corresponding folding operation of the corresponding lattice piece. The potential size of manually foldable lattice pieces is limited thereby.

As proposed in DE 10 2006 060 347 A1, an auxiliary crane possibly is provided for erecting the foldable lattice piece, since the weight forces to be overcome are too high for manually erecting the lattice piece without machine force.

SUMMARY

It is an aspect of the present invention to create a lattice piece which despite its large dimension remains suitable for road transport, wherein the folding operation of the lattice piece is simplified. In particular, a corresponding auxiliary crane should remain usable for other tasks or not be required at all.

In accordance with the invention, this object is solved by a lattice piece including four corner posts and of null bars and diagonal bars connecting the same, wherein at least a part of the null and diagonal bars are foldably articulated to at least one corner post, and at least one adjusting unit is provided for performing the folding movement, characterized in that at least one drive is connected or connectable with at least one adjusting unit.

According to an aspect of the present invention, the adjusting unit includes at least one partly telescopable diagonal bar.

According to an aspect of the present invention, the telescopable diagonal bar comprises a hydraulically driveable hydraulic cylinder which is connected or connectable with the drive.

According to an aspect of the present invention, the hydraulic cylinder is maintained in position by hydraulic oil.

According to an aspect of the present invention, six null bars and four diagonal bars are articulated to each corner post.

According to an aspect of the present invention, the null bars are at least partly telescopable and driveable by said at least one drive or an additional drive.

According to an aspect of the present invention, the telescopable diagonal bars and/or null bars each are fixed in their end position via bolt connections.

According to an aspect of the present invention, the connections between the corner posts and the diagonal and null bars are at least partly flexurally rigid.

According to an aspect of the present invention, a drive is connected or connectable with a lattice piece is provided.

According to an aspect of the present invention, a crane with at least one lattice piece and the drive is provided.

BRIEF DESCRIPTION OF THE DRAWING

A more complete appreciation of the invention, and many of the attendant advantages thereof, will be readily apparent as the same becomes better understood by reference to the following detailed description when considered in conjunction with the accompanying drawing in which like reference symbols indicate the same or similar components, wherein.

DETAILED DESCRIPTION

Figure 1:
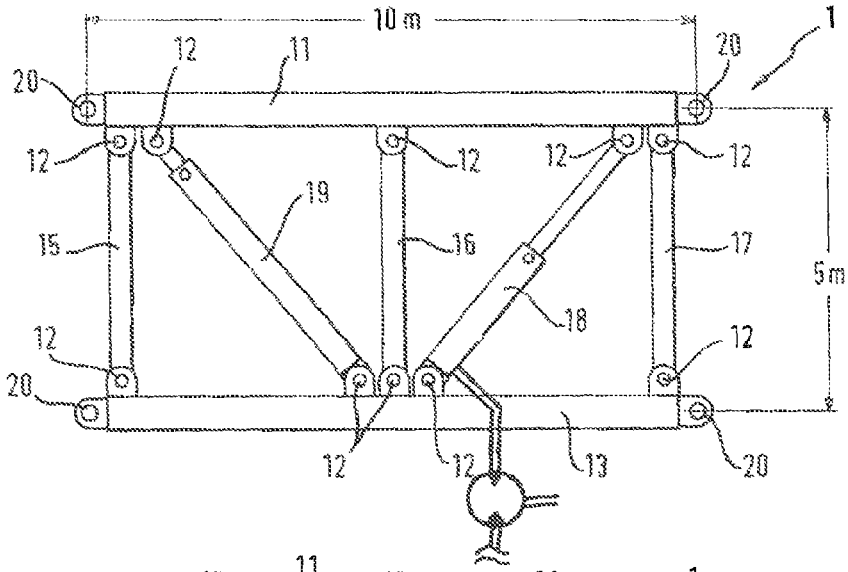
FIG. 1 shows a lateral representation of the lattice piece according to the invention in the erected form.

A lattice piece for a crane consists of four corner posts and of null bars and diagonal bars connecting the same. At least a part of the null and diagonal bars are foldably articulated to at least one corner post, wherein at least one adjusting unit is provided for performing the folding movement or the folding process. This provides for a lattice piece with a much larger dimension. The admissible transport dimension is taken care of in the folded condition.

Furthermore, at least one drive is provided in accordance with an embodiment of the present invention, which is connected or connectable with at least one adjusting unit. Accordingly, the folding operation is accomplished automatically by the drive. The expenditure of force is handled by the drive, so that distinctly larger foldable lattice pieces can be realized.

According to an embodiment of the present invention, for example, a lattice piece is proposed, which in use of the crane has a length of 10 m and a height of 5 m. The width of the lattice piece approximately is designed in the order of the height, wherein the same possibly can also be designed larger or smaller. In the folded condition, a height of about 3 m is achieved, whereby the relevant rules of the Road Traffic Regulations are maintained.

A plurality of such lattice pieces then form a lattice boom, in particular a main boom, a fly jib or also a derrick boom.

While the length of the lattice pieces can be chosen such that the length can be maintained during transport, the adjusting unit or the folding mechanism preferably is chosen such that a reduction of the height of the lattice piece is effected. The folding mechanism can of course also be used for reducing the lattice piece width, possibly in combination with the reduction in height.

Accordingly, the adjusting unit preferably includes at least one partly telescopable diagonal bar. By telescoping at least one diagonal bar in and out, the lattice piece is folded from the crane operating position into the collapsed form for the transport.

Preferably, the telescopable diagonal bar includes a hydraulically driveable hydraulic cylinder. The drive according to the invention, in particular a hydraulic pump with corresponding hydraulic lines, is connected with the hydraulically driveable hydraulic cylinder or is designed to be connectable with the same. The drive is connected with the adjusting unit or with the hydraulically driveable hydraulic cylinder only on demand and effects either a retraction or an extension of the cylinder.

It is imaginable, for example, that the hydraulic cylinder is pressurized with hydraulic pressure by the drive. As drive means or hydraulic means a hydraulic oil preferably is provided. After removing the drive from the hydraulic cylinder, the same is maintained in the current position by the drive means, in particular by the hydraulic oil.

Furthermore, the lattice pieces advantageously can include corner posts which have fork-finger connections at their ends. Individual lattice pieces can be connected with each other by means of these connections to form lattice booms. To each corner post six null bars and four diagonal bars can be articulated.

In addition, at least a part of the null bars likewise can be designed telescopable, for example by using a hydraulically driveable cylinder. The adjustability of the null bars possibly can be driveable by a drive. For adjusting the null bars either the same or an additional drive can be used.

Particularly advantageously, the telescopable diagonal bars and/or the telescopable null bars each can be fixed in their end position via bolt connections, i.e. in the crane operating position or in collapsed form.

The invention furthermore relates to a drive, in particular to a powerpack, which is connected or connectable with a lattice piece according to any of the preceding embodiments. For assembly or disassembly, the drive is connected with the adjusting unit of the lattice piece. During the crane work, the drive is separated from the lattice piece. An advantage consists in that for designing a lattice boom only one single drive is required, which is connected with the lattice pieces one after the other. The drive provides the necessary energy for assembly or disassembly of the lattice pieces, i.e. for actuating the folding mechanism.

Furthermore, the invention is directed to a crane, in particular to a mobile crane or crawler crane, with at least one lattice piece according to any of the preceding embodiments. Furthermore, the crane preferably provides a drive, in particular a powerpack for assembly or disassembly, i.e. for actuating the folding mechanism, of the individual lattice pieces.

FIG. 1 shows a lattice piece 1 according to an embodiment of the invention in a side view. This foldable lattice piece 1 consists of four corner posts 11, 13, wherein only the corner posts 11, 13 located at the front can be seen in the drawing. Furthermore, a larger number of null bars 15, 16, 17 and diagonals 18, 19 are provided. Thus, four side faces are obtained for the lattice piece 1, of which two side faces facing each other are constructed identically.

All connections between the corner posts 11, 13 and the null bars 15, 16, 17 or the diagonal bars 18, 19 are hinged about swivel axes 12. The swivel axes 12 are formed by bolts in a known manner.

The illustrated side face of the lattice piece 1 of the invention as shown in FIG. 1 reveals the two corner posts 11, 13 extending parallel to each other, which are connected with each other via the null bars 15, 16, 17. Furthermore, the two diagonal bars 18, 19 extend to the opposite corner post 11 proceeding from the connecting point of the middle null bar 16 at the corner post 13. The side face of the lattice piece 1 located behind the same in parallel is constructed identically.

Figure 2:
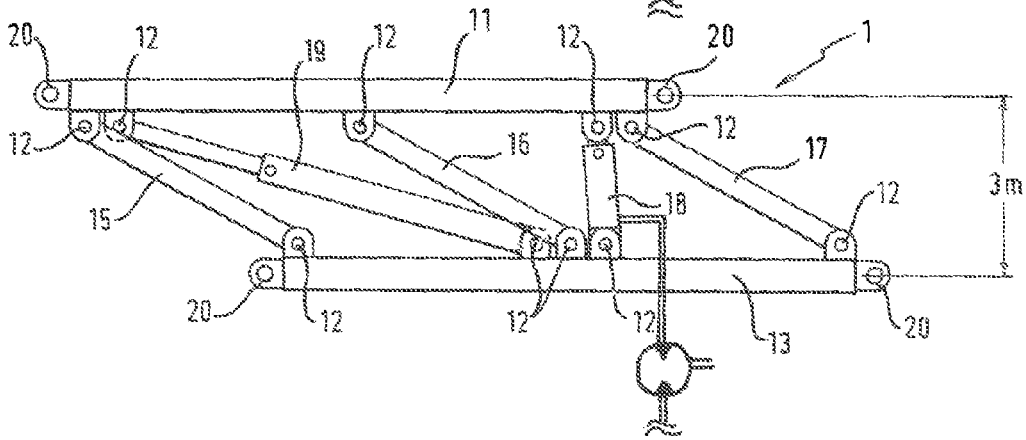
FIG. 2 shows a lateral representation of the lattice piece according to the invention in the collapsed form.
Figure 3:
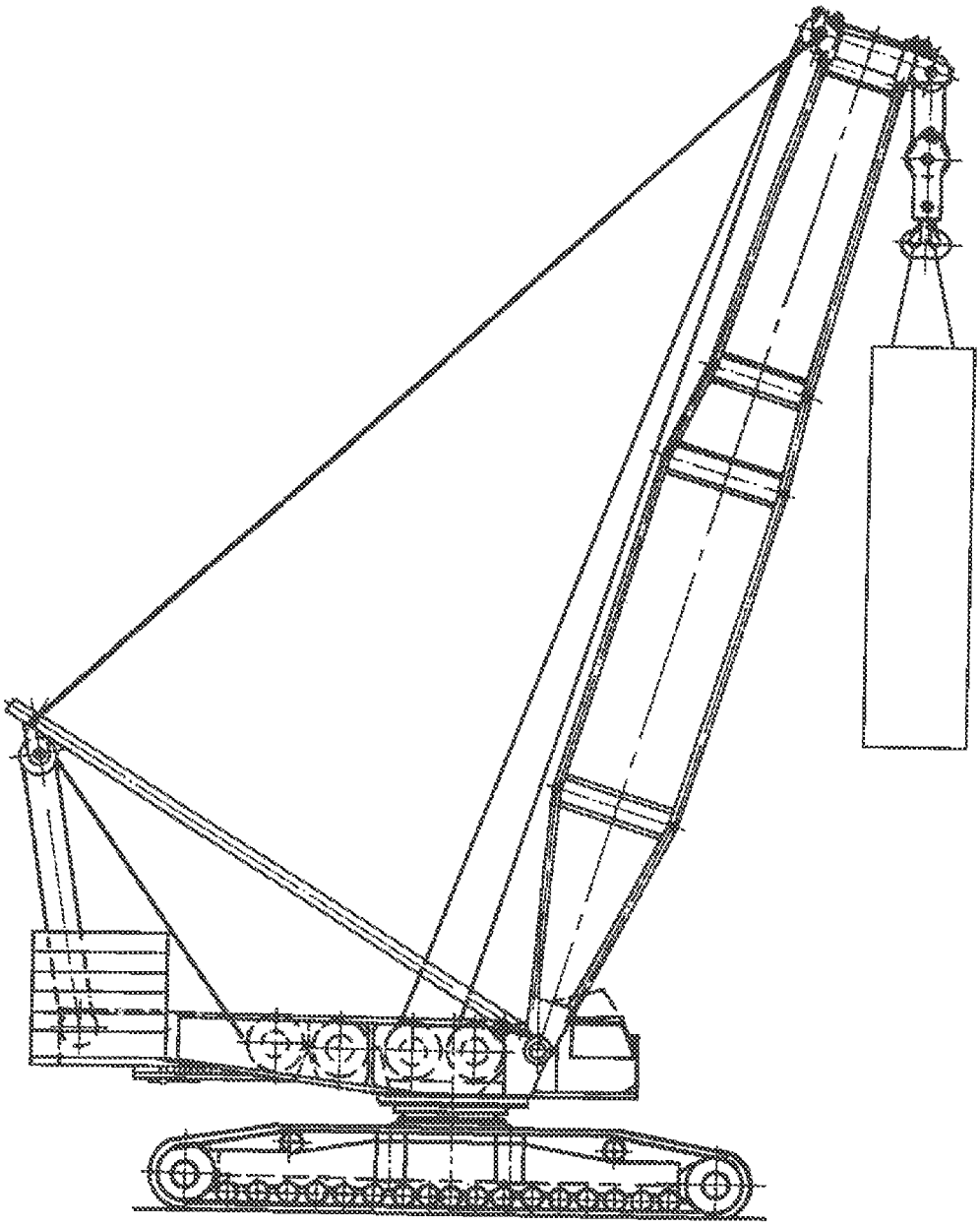
FIG. 3 is a schematic view of a crane.

The lattice piece 1, as it is shown in FIGS. 1, 2, for example has a length of 10 m and a height of 5 m in the non-folded form. The width of the lattice piece 1 approximately lies in the order of the height.

To be able to transport this lattice piece on the road, it can be folded together due to the pivotal connection between the corner posts 11, 13 and the corner posts of the side face located behind the same. The collapsed form is shown in FIG. 2.

The stability of the lattice piece 1 is achieved by the diagonally stretched-out diagonal bars 18, 19. The same prevent that the respective corner posts 11 opposite the corner posts 13 are folded into the collapsed position. In the illustrated embodiment, the diagonal bar 18 is designed to be actively variable in its length by means of the hydraulically driven cylinder unit. In the extended condition of the driven cylinder, the lattice piece 1 is erected and ready for the crane operation.

For folding together, the diagonal bar 18, i.e. the hydraulically driveable cylinder, is retracted. The retracting movement of the hydraulic cylinder effects a swivel movement of the upper side wall of the lattice piece 1 with the corner posts 11 to the left, wherein the null bars 15, 16, 17 swivel about their bearing points 12 at the corresponding corner posts 11, 13. The second illustrated diagonal bar 19 is telescoped out (i.e. extended) as a result of the swivel movement. For stabilizing the lattice piece 1 in the collapsed form, the telescopable diagonal bars 18, 19 are bolted in their corresponding end position.

Other than in the illustrated embodiment, it would be possible to likewise design the second diagonal bar 19 in the active form and as a hydraulically driveable cylinder. This would ensure synchronism of both sides or of the diagonal bars 18, 19.

To perform the swivel movement, an externally arranged powerpack is provided, which on demand can be connected with the active diagonal bar 18 of the lattice piece 1. By means of the powerpack, the hydraulically driveable cylinder of the diagonal bar 18 is pressurized with a corresponding hydraulic pressure which effects the corresponding folding movement of the lattice piece 1. After the assembly or disassembly of the lattice piece, the powerpack is separated from the lattice piece 1. In particular, this offers the advantage that only one single powerpack is required for mounting or demounting individual lattice pieces of a mobile crane one after the other.

Due to the folding mechanism explained, the lattice piece 1 according to the invention can reduce its height from 5 m to 3 m during operation of the crane. Since always only two directly adjacent corner posts 11, 13 are connected with each other, not only the height, but also the width of the lattice piece 1 could be reduced according to the same principle.

The lattice boom of a crane is composed of a plurality of the presented lattice pieces 1. The individual lattice pieces 1 are connected with each other via the fork-finger connections 20.

While the invention has been described in terms of what is presently considered to be the most practical and preferred Embodiments, it is to be understood that the invention needs not be limited to the disclosed Embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A lattice piece for a crane, comprising:

four corner posts comprising a first pair of corner posts comprised of a first corner post and a second corner post parallel to each other and a second pair of corner posts comprised of a third corner post and a fourth corner post parallel to each other, wherein the first pair of corner posts and the second pair of corner posts are parallel to each other; and null bars foldably hinged about swivel axes, the null bars comprising:

a first null bar connecting one end of the first corner post and one end of the second corner post;

a second null bar connecting the other end of the first corner post and the other end of the second corner post;

a third null bar connecting a center of the first corner post and a center of the second corner post;

a fourth null bar connecting one end of the third corner post and one end of the fourth corner post;

a fifth null bar connecting the other end of the third corner post and the other end of the fourth corner post; and a sixth null bar connecting a center of the third corner post and a center of the fourth corner post;

diagonal bars, a length of which is adjustable, the diagonal bars foldably hinged about swivel axes, comprising:

a first diagonal bar connecting the first corner post and the second corner post in a way that the first diagonal bar is diagonally positioned in a space formed from the first null bar and the third null bar connecting the first and second corner posts;

a second diagonal bar connecting the first corner post and the second corner post in a way that the second diagonal bar is diagonally positioned in a space formed from the second null bar and the third null bar connecting the first and second corner posts;

a third diagonal bar facing the first diagonal bar and connecting the third corner post and the fourth corner post in a way that the third diagonal bar is diagonally positioned in a space formed from the fourth null bar and the sixth null bar connecting the third and fourth corner posts; and a fourth diagonal bar facing the second diagonal bar and connecting the third corner post and the fourth corner post in a way that the fourth diagonal bar is diagonally positioned in a space formed from the fifth null bar and the sixth null bar connecting the third and fourth corner posts;

wherein the lengths of the first and third diagonal bars are extended and the second and fourth diagonal bars are retracted when the lattice piece is folded;

the lengths of the second and fourth diagonal bars are extended and the first and third diagonal bars are retracted when the lattice piece is erected the extended lengths of the first and third diagonal bars are longer than the extended lengths of the second and fourth diagonal bars.

2. The lattice piece according to claim 1, wherein the diagonal bars comprise a hydraulically driveable hydraulic cylinder which is connected or connectable with the at least one drive.

3. The lattice piece according to claim 2, wherein the hydraulic cylinder is maintained in position by hydraulic oil.

4. The lattice piece according to claim 1, wherein the null bars are at least partly telescopable and driveable by said at least one drive.

5. The lattice piece according to claim 1, wherein the diagonal bars and the null bars each are fixed in their end position via bolt connections.

6. The lattice piece according to claim 1, wherein the connections between the corner posts and the diagonal and null bars are at least partly flexurally rigid.

7. The crane comprising the lattice piece of claim 1.

* * * * *